United States Patent [19]

Howroyd

[11] Patent Number: 4,464,868

[45] Date of Patent: Aug. 14, 1984

[54] BUILDING CONSTRUCTION

[76] Inventor: Lawrence H. Howroyd, 50 Victoria St., Hobart, Tasmania, Australia

[21] Appl. No.: 264,409

[22] Filed: May 18, 1981

[51] Int. Cl.[3] ..... E04B 1/344

[52] U.S. Cl. ..... 52/69; 52/68

[58] Field of Search ..... 52/69, 68; 49/197, 200, 49/70; 160/190

[56] References Cited

U.S. PATENT DOCUMENTS

| | | | |
|---|---|---|---|
| 195,285 | 9/1877 | Hoyt | 52/69 |
| 2,052,757 | 9/1936 | Fitch | 52/69 |
| 2,366,793 | 1/1945 | Kuehner | 160/190 |
| 2,973,561 | 3/1961 | Jackson | 52/69 |
| 3,044,540 | 7/1962 | Hammersley | 52/68 X |
| 3,346,238 | 10/1967 | Dashio | 49/197 X |
| 3,464,161 | 9/1969 | Jonsson | 49/197 |
| 3,497,998 | 3/1970 | Thomas | 49/197 X |
| 3,511,529 | 5/1970 | Cutsinger | 52/69 X |
| 3,608,242 | 9/1971 | Braun | 49/200 X |

FOREIGN PATENT DOCUMENTS

| | | | |
|---|---|---|---|
| 2741552 | 3/1979 | Fed. Rep. of Germany | 52/69 |
| 1395851 | 3/1965 | France | 52/69 |

*Primary Examiner*—J. Karl Bell

*Attorney, Agent, or Firm*—Harness, Dickey & Pierce

[57] ABSTRACT

A building comprising a main structure with its own walls and roof, a secondary roof structure located with respect to at least portion of one wall of the structure so that it can be moved between a position in which it extends outwardly to form the roof of a verandah, porch, carport or the like and a more or less vertical position in which it substantially covers said portion of the wall the mounting of the secondary roof structure being such that it is biased to the outwardly extending position.

5 Claims, 8 Drawing Figures

BUILDING CONSTRUCTION

This invention relates to a building of the type which has a porch, verandah, carport or like shelter adjacent at least one of the exterior walls.

The object of the invention is to provide a building of the type described which can be readily rendered resistant to cyclones and the like by utilising the roof of the porch, verandah or carport.

In one form the invention resides in a building comprising a main structure with its own walls and roof, a secondary roof structure located with respect to at least portion of one wall of the structure so that it can be moved between a position in which it extends outwardly to form the roof of a verandah, porch, carport or the like and a more or less vertical position in which it substantially covers said portion of the wall the mounting of the secondary roof structure being such that it is biased to the outwardly extending position.

This invention will be better understood by reference to the following description when read in conjunction with the accompanying drawings wherein.

Figure 1:
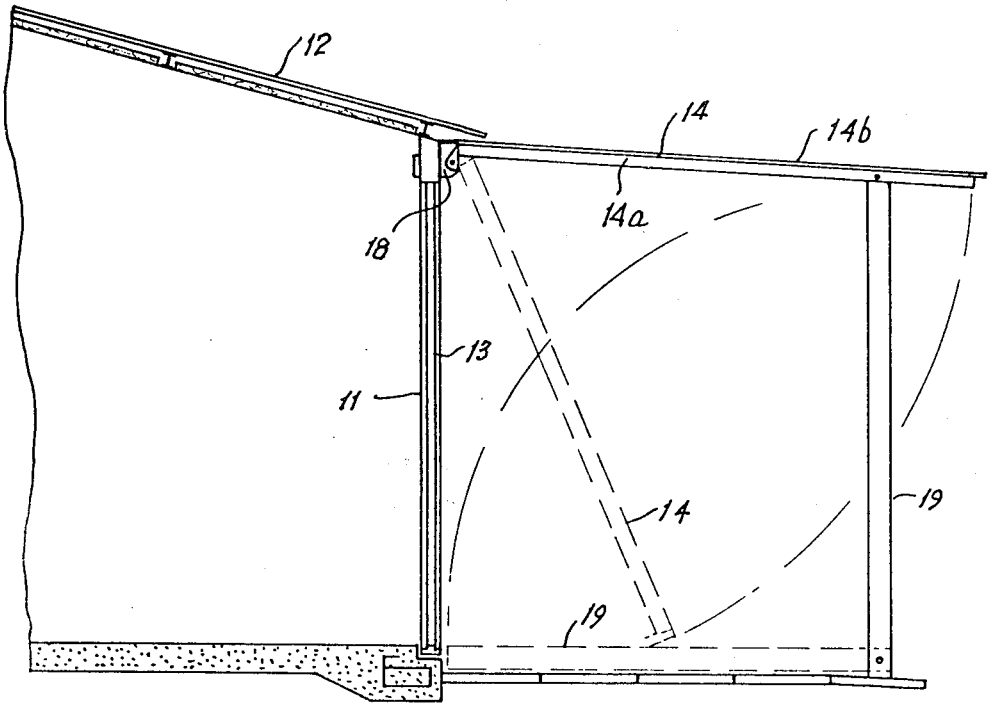
FIG. 1 is a fragmentary sectional elevation showing part of a building with the secondary roof structure forming a verandah roof.
Figure 2:
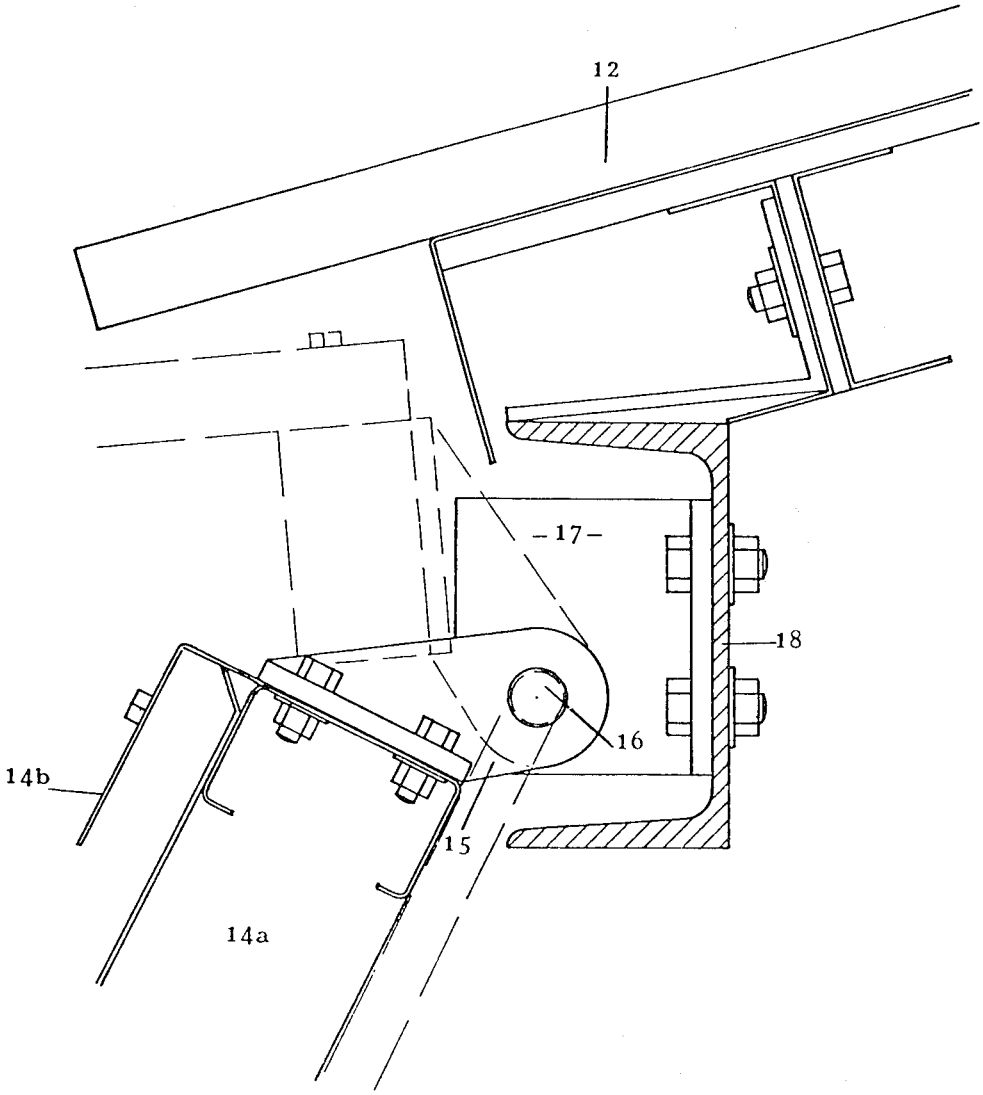
FIG. 2 shows one way of pivotally attaching the secondary roof structure to the main building.
Figure 3:
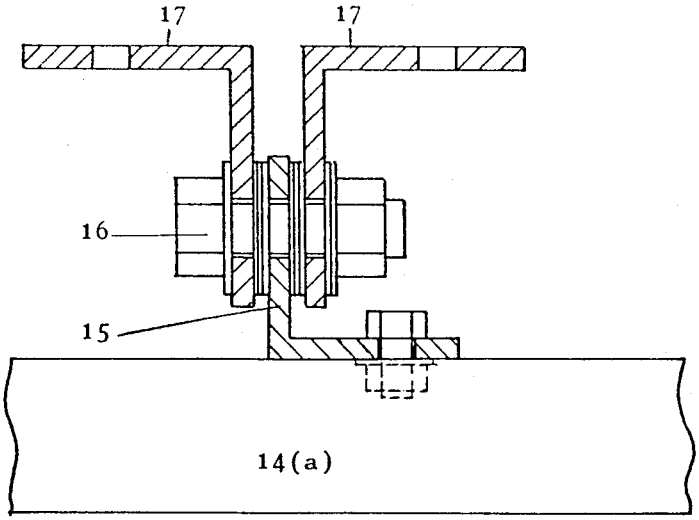
FIG. 3 is another view of the pivotal attachment of FIG. 2.
Figure 5:
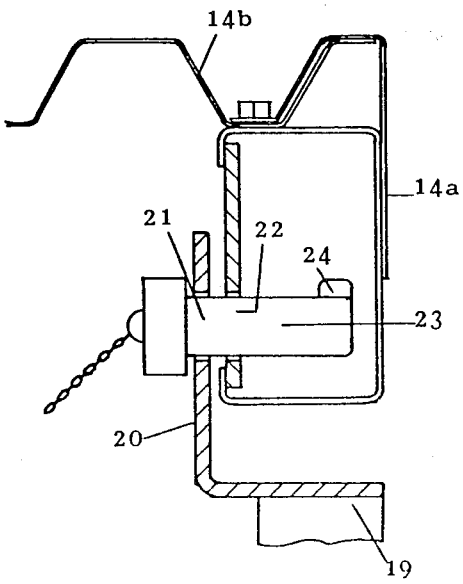
FIG. 5 is a fragmentary view showing the means for locking the supporting post in positions.
Figure 6:
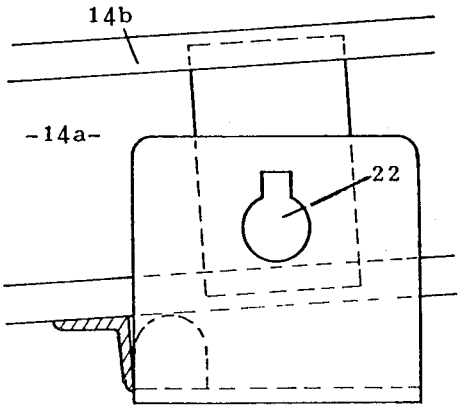
FIG. 6 is another view of the locking means of FIG. 5.

As shown in the drawings (FIGS. 1 to 7 inclusive) the main structure is a house of more or less conventional construction comprising exterior walls 11 and a roof 12. The wall 11 is fitted with sliding glass doors 13 and in accordance with the invention, a secondary roof structure 14 is pivotally mounted on the upper portion of the walls for rotation about a horizontal axis substantially parallel to the wall. The roof structure comprises a steel frame 14*a* covered with suitable metal sheeting 14*b*. As shown in FIGS. 2 and 3 the pivotal connection is effected through a lug 15 fixed to the roof frame 14*a* and pivotally engaging a bolt 16 supported in brackets 17 fixed to a beam 18 incorporated in the wall of the house. A supporting post 19 is pivotally mounted at its lower end in a bracket fixed to or embedded in the floor adjacent the outer edge of the floor of a verandah extending outwardly from the wall of the house. The upper end of the supporting post 19 is provided with a bracket 20 having a keyhole type slot 21 formed therein which aligns with a corresponding keyhole type slot 22 in the frame 14*a* of the roof.

A captive pin 23 provided at one end with a lug 24 is passed through the aligned slots to lock the post to the roof frame, when the roof is in the extended position.

Figure 4:
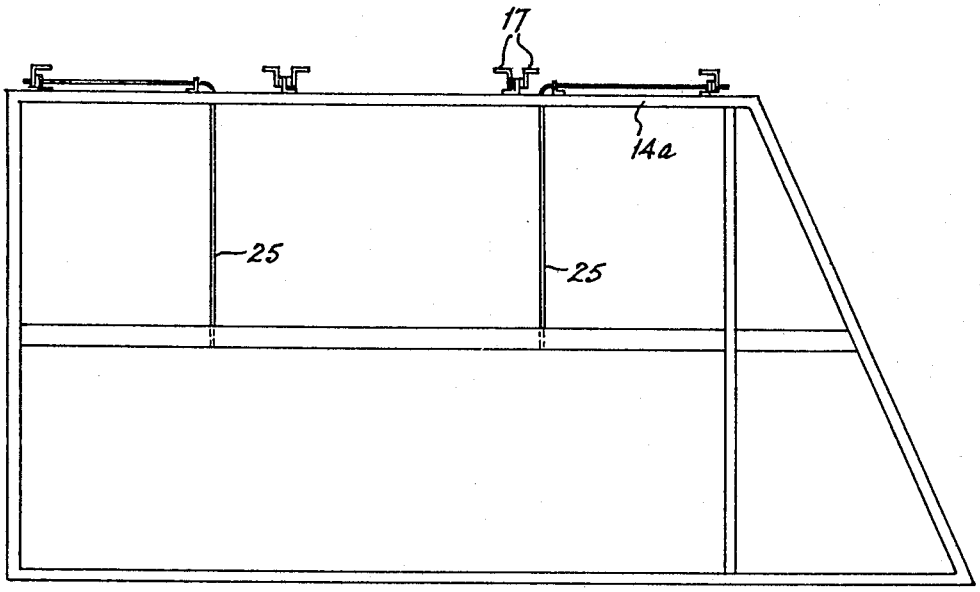
FIG. 4 is an inverted plan view showing the mounting of biasing means on part of the secondary roof structure.

The roof frame is biased towards the extended position by means of torsion rods 25 (see FIG. 4).

The roof structure preferably extends around all sides of the house and adjacent the corners is formed at an angle as is seen in FIG. 4 so that when in the lowered position the edges of adjacent roof structures on each side of the corner come together.

To lower the roof to the protective position (shown in broken lines in FIG. 1) the pin 23 is removed and the post 19 lowered to lie on the ground. The roof is then lowered to the protective position and its outer edge locked to the posts 19 by means of pins or spring loaded bolts (not shown) adapted to engage in holes in the post 19. With the roof in the lowered position the openings such as windows and doors are covered and protected against damage by cyclones or the like.

Whilst the invention has been described with particular reference to the use of torsion rods to bias the roof to the extended position other suitable means such as counterweights, hydraulic pistons and springs of various types may be used.

Figure 8:
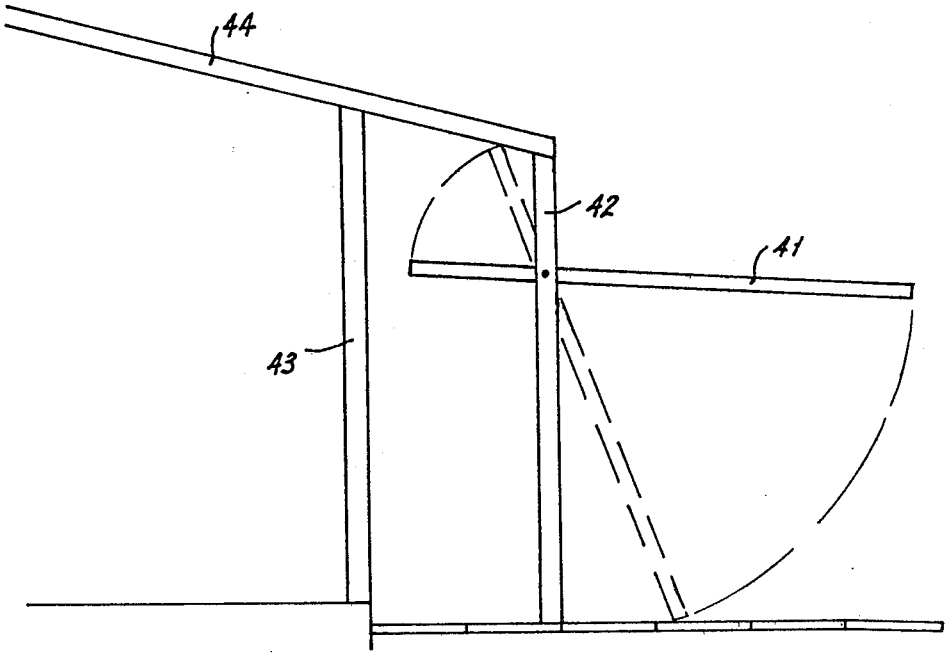
FIG. 8 is a fragmentary view showing an alternative embodiment.

In an alternative construction illustrated in FIG. 8 of the drawings the roof is pivotally mounted intermediate its ends on supporting posts spaced apart from the wall of the main structure so that the roof in effect becomes a balance beam which can be readily rotated to the desired position. Preferably the inner end may be weighted to bias it towards the outwardly extending position.

Figure 7:
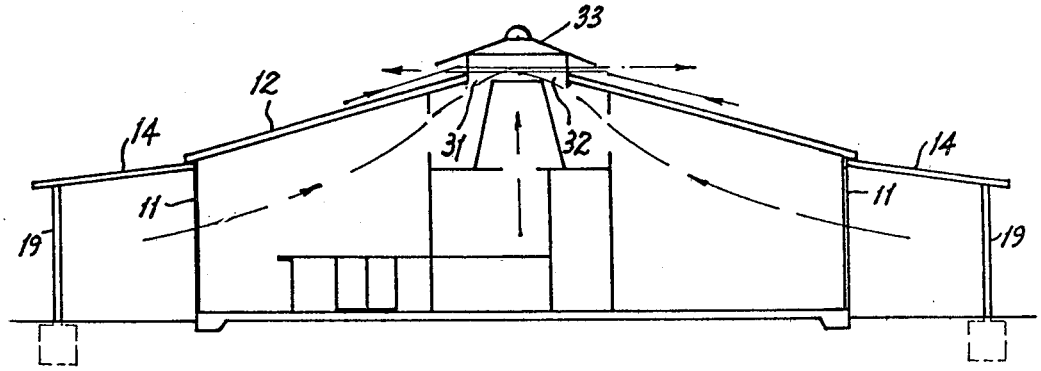
FIG. 7 is a sectional view showing how the building may be ventilated.

The house is preferably ventilated as is shown in FIG. 7 by providing below the apex of the roof a central chamber 31 provided at the top with an opening 32 passing through the roof. The opening is surmounted by a cowl 33 which covers and weatherproofs the opening but permits air to pass therethrough. The air passing over the roof and through the cowl exerts a suction effect on the air inside the house creating an air flow as indicated by the broken lines in FIG. 7.

I claim:

1. A building comprising a permanent main structure having interconnected walls and a roof, a secondary roof structure pivotally connected to a least a portion of one wall of the main structure for pivotal movement between a raised position in which it extends outwardly to form the roof of a verandah, porch, carport or the like and a substantially vertical lowered position in which said secondary roof structure substantially covers said portion of the wall, means for biasing said secondary roof structure to its raised outwardly extending position, a pair of support posts adapted to be pivotal to the ground independently of and spaced from said main structure for movement from a raised position wherein each of said posts is adpated to support a respective side of said secondary roof structure and a lowered position wherein said posts are substantially flush with the ground and extend from their pivotal supports toward said one wall portion, locking means for detachably connecting the upper ends of said posts to said secondary roof structure when said posts and said secondary roof structure are in their raised positions, and retaining means for detachably retaining said secondary roof structure to said posts when said posts and said secondary roof structure are in their lowered positions with the lower end of the seocndary roof structure disposed outwardly of the lower end of the one wall portion for providing a storage area between the secondary structure and said one wall portion when said secondary roof structure is in its lowered position to contain and protect articles.

2. A building as claimed in claim 1 wherein the secondary roof structure is biased to the outwardly raised extending position by means of torsion rods.

3. A building as claimed in claim 1 wherein the secondary roof structure is mounted intermediate its ends on supporting posts spaced apart from the one wall portion of the building so that it acts as a balance beam for biasing said secondary wall structure to its raised outwardly extending positon.

4. A building as claimed in claim 1 wherein the inner end of the secondary roof structure is weighted for biasing said secondary wall structure to its raised outwardly extending position.

5. A building as claimed in claim 1 wherein the locking means comprises removable pins.

* * * * *